United States Patent [19]

Quraishi

[11] Patent Number: 4,619,455

[45] Date of Patent: Oct. 28, 1986

[54] GAME APPARATUS

[76] Inventor: Azeez A. Quraishi, 549 Harley Dr., Apt. No. 6, Columbus, Ohio 43202

[21] Appl. No.: 672,063

[22] Filed: Nov. 16, 1984

[51] Int. Cl.[4] ..... A63D 3/00

[52] U.S. Cl. ..... 273/118 R; 273/9; 273/56

[58] Field of Search ..... 273/118 R, 123 R, 12, 273/56, 57, 9, 8; 446/111, 122

[56] References Cited

U.S. PATENT DOCUMENTS

| | | | |
|---|---|---|---|
| 14,290 | 2/1856 | Phelan | 273/9 |
| 83,759 | 11/1868 | Buzby | 273/12 |
| 575,097 | 1/1897 | Beman | 273/123 R |
| 640,423 | 1/1900 | Slemmer | 273/9 |
| 3,039,197 | 6/1962 | Abbott | 273/56 |

FOREIGN PATENT DOCUMENTS

| | | | |
|---|---|---|---|
| 1496503 | 12/1977 | United Kingdom | 273/118 R |

*Primary Examiner*—Richard C. Pinkham
*Assistant Examiner*—Benjamin Layno

[57] ABSTRACT

A game, using croquet-type balls corralled in an area of rebounder-type side rails, that can be assembled on any conventional rug or floor in which a taw ball is struck with a mallet to knock one's designated team balls, plus a "queen" ball, out of corral archway openings to gain points.

3 Claims, 5 Drawing Figures

GAME APPARATUS

FIELD OF INVENTION

1. Background of the Invention

One can hardly dispute the claim that both pool and croquet are two popular games. Pool requires an expensive specially designed table and equipment and is a permanent fixture. Croquet, on the other hand, calls for sufficient level ground space and accommodating weather which is not always available. The game I have invented combines the interest found in both games, yet requires no table or special outside playing field. It is portable and can be assembled and disassembled for storage. It can be played on practically any conventional rug or floor surface. It can be confined to a small area or expanded to cover a large area and can be set up in a matter of minutes. It can be played by both male and/or female individuals or team groups of all ages. The game being relaxing, entertaining and fun is especially devised for children to enhance qualities and skills of concentration, direction, competition, strategy, accuracy and team cooperation.

2. Summary of the Invention

The game, in its simplest form, consists of a corral of four, or more, rebounding side rails, that can be assembled on most any carpet or bare floor. The side rails, being approximately 2 inches high, are held rigidly together enclosing a square, rectangular, curved or polygonal shaped game playing area by corner gusset cross members arranged such that there is a ball passage opening out of said corral at each corner. The game is played with two sets of three spherical hard balls similar to croquet balls. Each set of balls is a different color. There is also a, so-called, "queen" ball of yet a different color and also a distinguishable taw ball—all are the same spherical size. The team balls are arranged around the "queen" ball in the center of the corral or playing field. The object of the game is for a player to strike the taw ball placed on his side of the striking line to then hit one of his or his team's three balls through the opening at one of the corners of the corral. A player or team, playing in turn, must knock all three balls through the, so-called, corral gates before the "queen" ball can be knocked out of the corral to gain points. A team ball counts one (1) but the "queen" ball counts five (5) in scoring. In brevity, details of the game rules will be omitted concerning where a player must stand to hit the taw ball, winning score, ball strategy, etc. but same is similar in other respects to the game of pool.

An objective of the invention is to provide a game that combines the interest of croquet and pool, yet can be played within an area of rails assembled on the floor.

Another objective is to establish in the game two sets of distinguishably different sets of team balls, a "queen" ball of another color and likewise a taw ball.

Another objective is to provide assembly of components such that the game playing area can be constructed of any desired size and shape.

Another objective is to provide the confining area with means of locking one side rail segment to another, or by hinging same together.

Another objective is to have specified indicia on the side rails of the game to establish limited taw placement areas.

With these objectives in mind, details of the game are hereby disclosed. Features of the invention will become apparent as one studies the representative diagrammatic drawings in which:

DESCRIPTION OF THE PREFERRED EMBODIMENT

Figure 1:
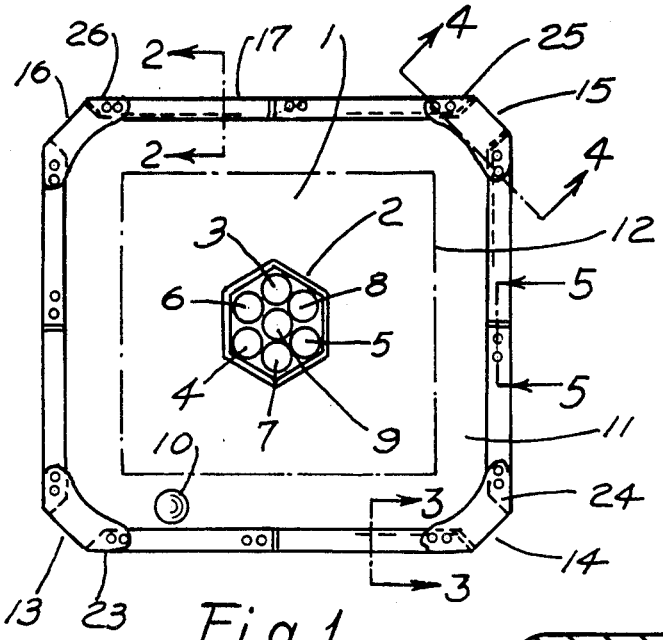
FIG. 1 is a plan view of the fenced in playing field of the game (hereinafter referred to as the "corral") showing the starting placement of the playing balls.

The game invention herein described is called "Dr. Q". In FIG. 1 the general playing area 1 (hereinafter referred to as "corral 1") has within its boundaries two sets of different color balls, 3, 4 and 5, being of one color and 6, 7 and 8 another color. At the center is a "queen" ball 9 of yet another color. The balls are registered in position within a hexagon frame 2 which is removed when the game is started. A taw ball 10 is always put into play action from the outer perimeter area of corral 1 confined to be outside of dotted line area 12. The illustration here shows only three game balls per player or team of players, but it is to be understood that there may be any number of balls used per player or team, as desired. The object of the game is for a player to strike the taw ball 10 with a mallet, not shown, directing the taw ball 10 to hit one of the colored balls of his team, say 3, 4 or 5, and drive same out of corral 1 through one of the corners through archway passages 13, 14, 15 or 16. When a player has knocked all of his color balls out of corral 1, he must then, and only then, knock the "queen" ball 9 out of the corral by the same procedure to win. Each team ball counts one and the "queen" ball counts 5 points. Other minor rules are invoked, but not significant to the general explanation of the game.

Figure 2:
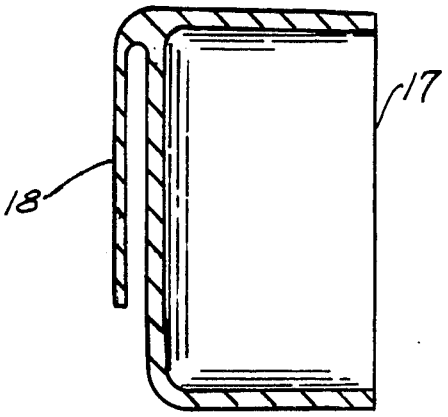
FIG. 2 is an actual size cross-sectional view in the direction of arrows 2—2 on FIG. 1 showing the preferred design of the side rails of the, so-called, corral.
Figure 3:
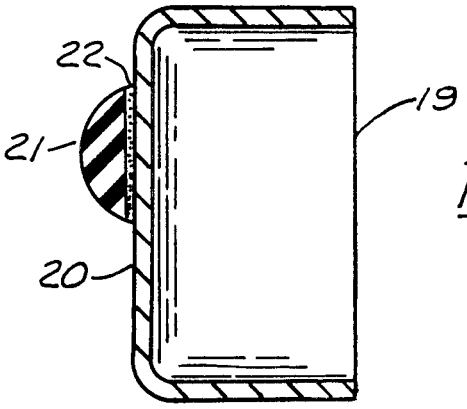
FIG. 3 is an actual size cross-sectional view in the direction of 3—3 on FIG. 1 showing an optional design of the side rails.
Figure 4:
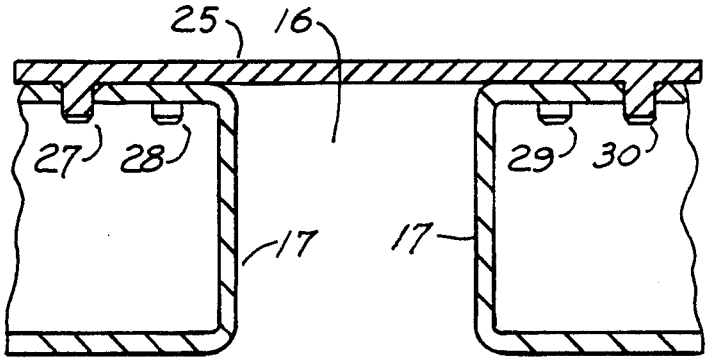
FIG. 4 is an enlarged cross-sectional view in the direction of 4—4 on FIG. 1 showing the dowelled gusset cross member as it is attached to the side rails making a corner corral passageway outlet for the game playing balls.
Figure 5:
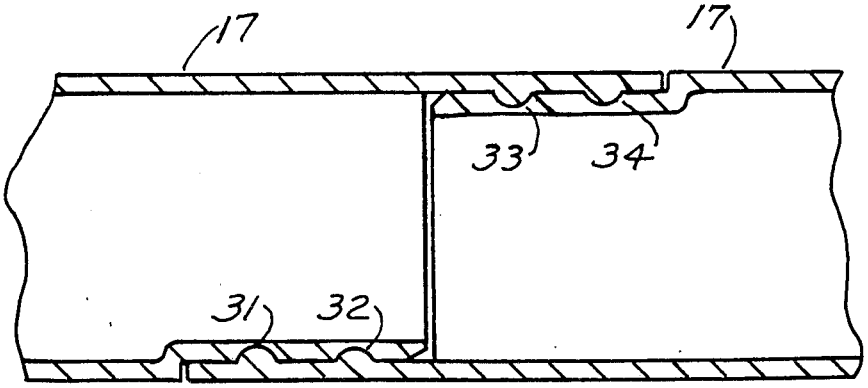
FIG. 5 is an enlarged cross-sectional view in the direction of 5—5 on FIG. 1 showing the preferred locking arrangement of one side rail of the corral to another.

Corral 1 is constructed of a plurality of side rails 17. There may be as few as four, but there can be any number assembled together to make a playing area as large as desired. Corral 1 can be either square, rectangular, polygonal or curved in shape. In FIG. 2 the shape of side rail 17 of corral 1 as seen across arrows 2—2 is shown in its preferred embodiment. It may be constructed of metal, plastic or other material. The inner corral side of the rail 18 acts as a ball rebounding surface. FIG. 3 is an alternate designed corral side rail 19 as seen across arrows 3—3. It can also be made of solid or hollow wood, plastic, metal or other material. Adhered to the inner corral side 20 of rail 19 is a polymer runner 21 applied to said rail by means of an adhesive backing 22. FIG. 4 shows a gusset cross member 25 as seen across section 4—4 having dowel pins 27, 28, 29 and 30 that fit into mating hole openings in side rails 17, thus holding the corral rigid and at the same time providing a through ball passage archway 15. Other gusset cross members 23, 24 and 26 are at each of the other corners of corral 1 providing archway openings 13, 14 and 16, respectively. FIG. 5 shows the preferred side rail 17 locking method for rail attachments. The right and left hand rails are pushed together and held in place by detents 31, 32, 33, and 34, which drop into locking position receptacle holes in the identically designed rails shown turned end-from-end.

What I claim is:

1. An enclosure for a game involving balls within the enclosure comprising, at least four side rails joined together to form a rectangular enclosure with at least four corners; each rail including a lower surface to rest on a floor, an upper surface remote from said floor a distance greater than one-half the diameter of balls used in the enclosure, and an inner surface extending between and joined to the upper and lower surfaces, a rebound surface attached to each said rail and projecting inwardly from said rail to (1) engage balls impacting on the rail and (2) absorb the impact by deflection and rebound, said rebound surface being configured to engage the ball at its horizontal center line, each rail having an end terminating adjacent a corner, each corner including two rail ends spaced from each other and said two rails ends being oriented such that they are not aligned linearly, the spacing between the rail ends defining a passage for balls, each rail end having at least two apertures in its upper surface, a cross member bridging across the space between the rail ends at each corner, each said cross member being spaced upwardly from the floor a distance greater than the diameter of the balls, at least four pins projecting downwardly from each said cross member into said apertures, at least two said pins projecting into at least two apertures in each rail end to thereby hold the rails against relative rotation or horizontal movement.

2. The enclosure of claim 1 wherein each rail has a second end remote from a corner, each said remote end including at least two detents and at least two receptacle holes, said detents and holes being formed in the upper and lower surfaces, the ends of the rails remote from said corners being configured to fit together with mating holes and detents to hold the rails against relative rotation or horizontal movement.

3. The enclosure of claim 2 wherein the remote ends each include a horizontal surface offset toward the center of the rail from one of the upper and lower surfaces, the offset surface including the holes.

* * * * *